US006928974B1

(12) United States Patent
Markou

(10) Patent No.: US 6,928,974 B1
(45) Date of Patent: Aug. 16, 2005

(54) REINFORCEMENT PLATE FOR A RECIPROCATING ENGINE

(76) Inventor: Demetrios Markou, 6 Surry La., Lemont, IL (US) 60439

( * ) Notice: Subject to any disclaimer, the term of this patent is extended or adjusted under 35 U.S.C. 154(b) by 0 days.

(21) Appl. No.: 10/948,694

(22) Filed: Sep. 24, 2004

Related U.S. Application Data

(60) Provisional application No. 60/540,293, filed on Jan. 30, 2004.

(51) Int. Cl.[7] ..... F01B 1/02
(52) U.S. Cl. ..... 123/195 R; 123/123; 123/195 H
(58) Field of Search ..... 123/195 R, 195 A, 123/195 C, 195 S, 195 H, 198 DA, 198 E, 123/198 P

(56) References Cited

U.S. PATENT DOCUMENTS

| | | | | |
|---|---|---|---|---|
| 3,046,954 A | | 7/1962 | Hoffman et al. | |
| 3,841,203 A | | 10/1974 | Bruce | |
| 4,219,002 A | | 8/1980 | Danckert et al. | |
| 4,465,041 A | | 8/1984 | Hayashi | |
| 4,467,754 A | * | 8/1984 | Hayashi et al. | 123/195 H |
| 4,515,119 A | * | 5/1985 | Hayashi et al. | 123/198 E |
| 4,656,983 A | | 4/1987 | Anno | |
| 4,771,747 A | | 9/1988 | Ballheimer et al. | |
| 4,793,299 A | * | 12/1988 | Ishimura et al. | 123/195 R |
| 4,831,978 A | | 5/1989 | Iguchi et al. | |
| 4,876,998 A | | 10/1989 | Wünsche | |
| 4,911,117 A | | 3/1990 | Nishimura et al. | |
| RE33,575 E | | 4/1991 | Ballheimer et al. | |
| 5,009,205 A | | 4/1991 | Abe et al. | |
| 5,247,915 A | * | 9/1993 | Sasada et al. | 123/195 H |
| 5,501,529 A | | 3/1996 | Cadle et al. | |
| 6,374,794 B1 | | 4/2002 | Dudemaine | |
| 6,543,405 B2 | * | 4/2003 | Sachdev et al. | 123/195 R |

FOREIGN PATENT DOCUMENTS

| | | |
|---|---|---|
| JP | 61-294160 | 12/1986 |
| JP | 63-253158 | 10/1988 |
| JP | 09-264187 | 10/1997 |

* cited by examiner

*Primary Examiner*—Mahmoud Gimie
(74) *Attorney, Agent, or Firm*—Richard C. Litman

(57) ABSTRACT

The reinforcement plate for a reciprocating engine greatly reduces relative movement of the main bearings of a reciprocating engine, thereby reducing structural fatigue to increase engine durability and longevity. The reinforcement plate also maintains a more precise alignment between the main bearings to reduce friction during operation. The plate comprises a flat, planar steel sheet having opposite sides which fit within the lower skirt of the engine block. A series of lateral ribs or bars extend across the plate and bolt to all of the main bearing caps of the engine, using the stock cap bolts. Crankshaft counterweight and crank throw clearance openings, as well as other clearance areas, are provided in the plate. The reinforcement plate is adapted particularly well for installation in General Motors LS-1 aluminum block engines, but may be configured for installation in a number of different engines as desired.

20 Claims, 6 Drawing Sheets

REINFORCEMENT PLATE FOR A RECIPROCATING ENGINE

CROSS-REFERENCE TO RELATED APPLICATION

This application claims the benefit of U.S. Provisional Patent Application Ser. No. 60/540,293, filed Jan. 30, 2004.

BACKGROUND OF THE INVENTION

1. Field of the Invention

The present invention relates generally to components and accessories for reciprocating internal combustion engines, and more particularly to a plate for installation across the main bearing caps of such an engine, and serving to tie the caps more rigidly together to increase the strength and rigidity of the engine block. The present reinforcement plate is particularly adapted for installation on a General Motors LS-1 engine of approximately 5.7 liters displacement, but may be adapted (with dimensional modifications as required) to virtually any reciprocating internal combustion engine.

2. Description of the Related Art

The internal combustion engine has been known since the latter part of the nineteenth century, and has seen continuous revisions and refinements over the years. Initially, such engines produced relatively little power for their size and weight, with metal fatigue due to flexing and stress being of little concern, even with the relatively weak metals available at the time.

However, as reciprocating engine technology was refined over the decades, the additional power output of such engines resulted in a need for greater consideration of the internal stresses imposed upon such an engine due to the power impulses developed during operation. Accordingly, advanced metallurgy has resulted in stronger metals for use in casting, forging, and machining of the various components used in such engines, and better engineering and manufacturing technology have resulted in more efficient castings, forgings, and machined parts for such engines. However, engines in mass production have certain constraints regarding the economics of manufacture, and many such engines may be improved structurally through the installation and use of various aftermarket components which the manufacturer deems to be economically unfeasible at the time of manufacture.

This is particularly true in the case of relatively high performance engines, which have relatively high power output for their size and weight. A case in point is the General Motors LS1 V-8, which has on the order of 5.7 liters or 350 cubic inches of displacement. This is a so-called "small block" V-8, which has been developed over multiple generations from an earlier, cast iron block V-8 having a displacement of only about 4.3 liters, or 283 cubic inches. Further development of this engine has resulted in relatively lightweight aluminum blocks having considerably greater displacement (depending upon the crankshaft stroke) than the original engine, and thus being capable of developing considerably more power. In addition, improvements in fuel antiknock qualities, as well as fuel injection, electronic ignition, and other refinements, have resulted in an engine in its stock form which is capable of developing well over twice the power of the original engine, and considerably more than that when modified. The additional power developed results in proportionally greater internal stresses in the engine during operation, with even such apparently rigid components as the engine block actually twisting and moving during engine operation. While such movement is extremely small, on the order of a few to perhaps several thousandths of an inch, the rapid flexing which occurs results in fatigue stress of the engine block and other components, which over some period of time can lead to engine damage and failure.

While these stresses and movements exist in stock engines as well as in modified engines, engineers working with stock engines have developed such engines to the point that they are quite reliable, with engine blocks and other major components typically lasting for well over one hundred thousand miles without failure. However, engines which have been modified for greater power are a different matter. The stresses developed by the greater power output of such modified engines can often result in engine damage in a relatively short period of time. This may be acceptable to those involved in racing events, and who are willing to rebuild their engine(s) relatively frequently. There is another consideration, however, and that is that the twisting and other movement of components leads to the slight misalignment of components, and correspondingly greater frictional wear of bearings and other components within the engine.

The present invention responds to these problems by providing a flat, planar reinforcement plate configured for attachment across the main bearing caps of a reciprocating internal combustion engine, thereby serving to tie the bearing caps more rigidly together and to greatly reduce relative movement between the main bearings in the engine. This reduction of relative movement between bearing caps thus greatly improves the alignment of the bearings during engine operation, thereby greatly reducing bearing friction and improving operational efficiency of the engine. Moreover, as the bearing caps are bolted to the block and the present reinforcement plate is bolted across the bearing caps to tie them rigidly together, movement of the engine block is constrained, thereby reducing fatigue stresses in the block. While the present reinforcement plate is adaptable to virtually any reciprocating internal combustion engine, it is particularly well suited for installation in General Motors LS-1 V-8 engines having aluminum engine blocks, and even more particularly in such engines which have been modified to produce a greater power output than stock.

A discussion of the related art of which the present inventor is aware, and its differences and distinctions from the present invention, is provided below.

U.S. Pat. No. 3,046,954 issued on Jul. 31, 1962 to Carl S. Hoffman et al., titled "Crankcase And Bearing Structure For Internal Combustion Engines," describes numerous embodiments of engine main bearing reinforcements. Most of the embodiments comprise multiple component links stamped of relatively thin metal which tie only two adjacent bearing caps together along one side of the engine, rather than spanning all of the main bearing caps to interconnect all of the caps, as in the present invention. In one embodiment of Hoffman et al., an elongate stamped component is secured to the main bearing caps along each side of the engine, but this still requires two separate and non-interconnected components, rather than the single, unitary, monolithic reinforcement plate of the present invention. In another Hoffman et al. embodiment, a single plate is provided which is bolted to all of the main bearing caps directly beneath the crankshaft, but this single plate does not use the main bearing cap bolts to anchor it to the bearing caps. Rather, a series of smaller bolts are used to bolt the continuous plate to the bearing caps, thus obviating much of the advantage of spanning the bearing caps with a single, unitary plate. Moreover, none of the embodiments of the Hoffman et al. reinforcements extend the entire length of the multiple bearing cap assembly and also span the entire internal width of the crankcase at the lower surface of the bearing caps, as does the present reinforcement plate.

U.S. Pat. No. 3,841,203 issued on Oct. 15, 1974 to Glenister S. Bruce, titled "Reciprocating-Piston Engines And Compressors," describes a relatively thick plate formed by casting or forging, which is bolted to the bottoms of the main bearing caps of an engine or compressor. While Bruce illustrates an engine having four bolt main bearings, i.e. two bolts secure each of the bearing caps to the upper bearing support along each side thereof, for a total of four bolts per bearing and cap, he utilizes only the two outermost bolts to secure his plate to the bearing caps, rather than using all of the lower cap bolts for greater strength, as in the present invention. Moreover, Bruce requires some modification to the engine in order to install his reinforcement, at least in the form of longer outboard bearing cap bolts to accommodate the thickness of his plate. The present invention has been configured so as to avoid any requirement for modification to the engine or to require the substitution of any parts during the installation.

U.S. Pat. No. 4,219,002 issued on Aug. 26, 1980 to Hermann Danckert et al., titled "Sound Insulated Internal Combustion Engine," describes the installation of a surrounding jacket or shell for such an engine to reduce the sound output from the engine itself. The assembly includes a "carrier ring" which is bolted to the bottom of the block, with the shroud attachment flange installed beneath the ring and the oil pan finally installed beneath the shroud. The entire assembly is separated from the engine block by a thick, relatively soft and resilient sound dampening gasket or the like, which does not allow any resistance to flexing and movement to be transmitted from the carrier ring and/or shroud attachment flange to the engine block. It is also noted that the components of the Danckert et al. sound insulation assembly do not attach to the bearing caps of the engine, and thus do nothing to maintain the relative rigidity and alignment of the bearing caps.

U.S. Pat. No. 4,465,041 issued on Aug. 14, 1984 to Yoshimasa Hayashi, titled "Cylinder Block Of Internal Combustion Engine," describes the integral installation of a ferrous metal reinforcement in the lower portion of a light metal alloy (aluminum, etc.) engine block. While Hayashi describes the use of ferrous metal, the metals he describes are relatively low strength, i.e. cast iron or mild steel. Also, the Hayashi reinforcement must be accomplished at the time the engine block is cast, as the Hayashi reinforcement forms an integral part of the block. Moreover, as the Hayashi reinforcement is integrated with the block, it cannot serve to tie the main bearing caps of the engine together, as the caps are bolted to the block during engine assembly after the block has been cast and machined.

U.S. Pat. No. 4,656,983 issued on Apr. 14, 1987 to Nobuo Anno, titled "Crankshaft Supporting And Lubricating Structure For Multicylinder Internal Combustion Engines," describes the installation of a "bridge" formed as a relatively complex casting and having a series of oil passages therein, for attachment across the main bearing caps of an engine. The Anno device requires modification of the engine, in that the bearing caps must be drilled to provide oil passages which communicate with the bridge when it is installed. The present invention is not directed to improving the lubrication of the engine, other than by maintaining more precise alignment of the main bearings by means of the increased engine block and bearing cap rigidity provided by its installation.

U.S. Pat. No. 4,771,747 and Reissue No. 33,575 issued respectively on Sep. 20, 1988 and Apr. 23, 1991 to Benny Ballheimer et al., titled "Internal Combustion Engine Noise Reduction Plate," both describe a plate which attaches across the lower portion of the block. In each embodiment, the Ballheimer et al. plate bolts to the lower edge of the block, to a flange extending inwardly from the skirt edge. The oil pan is bolted to another, externally extending flange coplanar with the inward flange. This block construction is unconventional for Otto cycle (four stroke cycle) internal combustion engines, and accordingly, the present reinforcement plate does not attach directly to the engine block itself. Rather, the present reinforcement plate bolts across all of the main bearing caps of the engine, to tie the caps rigidly together. The Ballheimer et al. plate does not attach or contact the main bearing caps of the engine.

U.S. Pat. No. 4,831,978 issued on May 23, 1989 to Isamu Iguchi et al., titled "Internal Combustion Engine Having Reinforced Structure," describes another reinforcement plate which bolts to the lower edge of the skirt of the engine block, rather than bolting to the main bearing caps, as in the present reinforcement plate. The reinforcement plate of Iguchi et al. is a three dimensional, cast structure of relatively complex configuration in comparison to the present flat, planar reinforcement plate, and thus more closely resembles the reinforcement plate of the Bruce '203 U.S. patent discussed further above, than it does the present invention. No provision for attachment to the main bearing caps is provided by Iguchi.

U.S. Pat. No. 4,876,998 issued on Oct. 31, 1989 to Peter Wunsche, titled "Crankcase For Internal Combustion Engines," describes a specially formed engine block and oil pan, with the pan including longitudinal stiffeners therealong. The pan is bolted to the bottom of the block in an inwardly extending bolt pattern, as opposed to the conventional peripheral pattern normally used. While the Wunsche oil pan may provide additional stiffness for the engine block, it does not attach to the main bearing caps of the engine, as does the present reinforcement plate.

U.S. Pat. No. 4,911,117 issued on Mar. 27, 1990 to Kazuaki Nishimura et al., titled "Arrangements For Supporting Crankshafts In Multicylinder Engines," describes different embodiments of a brace which bolts to the main bearing caps of the engine and spans each main bearing with an arched connecting component. Additional bolts pass laterally through the device. The Nishimura et al. brace comprises a relatively complex, three dimensional casting or forging in comparison to the flat plate of the present reinforcement device, and the arched components between each of the bearing caps cannot provide the rigidity in tension and compression which is provided by the rigid, flat plate of the present reinforcement device. Moreover, the Nishimura et al. device is relatively narrow, and does not span the entire crankcase from side to side for the length of the crankcase, as provided by the present invention. The Nishimura device is adapted for use only with relatively low power engines having only two bolts per main bearing cap.

U.S. Pat. No. 5,009,205 issued on Apr. 23, 1991 to Ryoji Abe et al., titled "Crankshaft Supporting Structure For An Internal Combustion Engine," describes different embodiments of a combination oil pan and reinforcement plate. The device comprises a relatively complex, three dimensional component which must be cast or forged, rather than the flat plate of the present invention. The engine of the Abe et al.

reinforcement must be specially modified and configured to provide for the installation of their reinforcement device. Moreover, the bearing caps of the engine must be specially configured as well, to have downwardly extended, opposed ears or lugs to which the reinforcement plate attaches. The Abe et al. reinforcement device is not adaptable as an aftermarket component which may be quickly and easily installed in the field on an existing engine with no modification being required to that existing engine, as is the case with the present reinforcement plate invention.

U.S. Pat. No. 5,501,529 issued on Mar. 26, 1996 to Terry M. Cadle et al., titled "Bearing Support Insert," describes an engine construction in which the upper portion of the main bearing housing, i.e. that portion which comprises a permanent component of the engine block, is integrally cast with the block at the time of engine manufacture. A conventional main bearing cap is bolted to the insert to hold the crankshaft in place after the engine has been machined and assembled. While this may provide a somewhat stronger lower end for the engine, there is no provision by Cadle et al. for a reinforcement plate which may be installed without modification to an existing engine.

U.S. Pat. No. 6,374,794 issued on Apr. 23, 2002 to Jean-Pierre Dudemaine, titled "Power Unit Including An Oil Pan Separation Piece," describes a relatively thick, three dimensional component having a series of bolt passages extending longitudinally from, one end thereof with a series of mounting holes passing therethrough. The device is bolted to the bottom of the block along with the oil pan, with the device sandwiched between the skirt of the block and the oil pan attachment flange; no main bearing cap attachment is provided. The longitudinal bolt holes provide additional attachment of the engine block to the transmission, which is the main point of the Dudemaine component. A potential problem of such relatively thick components attached to the bottom of the engine, is the lowering of the oil pan to a point where it may interfere with vehicle structural members and/or contact the underlying surface. The thin configuration of the present plate poses no such hazards.

Japanese Patent Publication No. 61-294,160, published on Dec. 24, 1986, describes (according to the drawings and English abstract) a pair of embodiments for a reinforcement plate installed across the main bearing caps and lower skirt of the engine block. The Yanmar Diesel reinforcement plate resembles the plate of the Abe et al. '205 U.S. patent discussed immediately above, more closely than it does the present invention. The complex casting or forging and the relatively great thickness of the Yanmar Diesel plate result in greater expense, more complex installation, and possible interference with other structures.

Japanese Patent Publication No. 63-253,158, published on Oct. 20, 1988, describes (according to the drawings and English abstract) a complex stamped sheet metal plate with multiple ribs and other reinforcing components. The device secures to the engine block between the edge of the skirt and the oil pan, as well as to the main bearing caps. Sealing the device around the skirt and oil pan appears to be of some concern in the Mazda Japanese Patent Publication, as multiple gaskets are used with various butt and tongue and groove joints therebetween. As the present reinforcing plate does not extend between the edges of the engine block skirt and oil pan, no additional sealing is needed other than the stock oil pan gasket.

Finally, Japanese Patent Publication No. 9-264,187, published on Oct. 7, 1997, describes (According to the drawings and English abstract) another plate formed of numerous thin sheet metal parts. The plate of the '187 Japanese Patent Publication also attaches between the skirt of the engine block and the oil pan and to the main bearing caps, but uses a series of smaller, secondary bolts to secure to the caps rather than using the bearing cap bolts themselves. Moreover, the '187 plate attaches only to the second and fourth bearing caps in the four cylinder inline engine, rather than attaching to all five of the caps, as in the present reinforcement plate.

None of the above inventions and patents, either singly or in combination, is seen to describe the instant invention as claimed. Thus a reinforcement plate for a reciprocating engine solving the aforementioned problems is desired.

SUMMARY OF THE INVENTION

The present reinforcement plate for a reciprocating engine serves to stiffen the multiple main bearing cap assembly of a reciprocating engine, and greatly reduces relative movement between the caps. This greatly reduces fatigue of the lower portion of the engine block, as well as reducing bearing friction due to the slight misalignment of the crankshaft bearings due to bearing cap movement during engine operation. The harmonic frequencies of the engine are raised and their amplitudes reduced due to the increased stiffness, as well. The result is a much more durable and more efficient engine.

Several additional benefits have been found in addition to the benefits described above. As a result of the stiffening of the lower end of the engine block, distortion of the cylinders is greatly reduced during operation as well. Although the LS-1 engine is equipped with steel cylinder liners, these liners will distort in a stock engine, due to the distortion of the block at relatively high power and RPM. This leads to "flutter" of the piston and/or oil control rings, which allows excessive oil to be drawn past the rings and into the combustion chamber during the intake stroke when cylinder pressure is lower than atmospheric. The result is excessive oil consumption, which can often lead to a quart of oil consumption per 1500 miles, or worse, in LS-1 engines.

Excessive oil consumption results in several negative aspects for both the engine and the environment. Insofar as the engine is concerned, excessive oil in the combustion charge contaminates the fuel/air mixture, and results in lowering the effective antiknock rating of the fuel. Most modern engines have electronically controlled ignition and fuel delivery systems, and have been tuned to have a relatively small margin between normal operation and harmful detonation. The addition of oil to the combustion charge, may result in the engine going beyond the limit and the sudden detonation of the fuel/air mixture in one or more of the cylinders. Detonation is known to result in rapid damage to an engine, in a matter of seconds in extreme cases.

Another negative aspect of such oil consumption is the potential buildup of carbon deposits in the combustion chamber, which may result in hot spots in the chamber which can produce preignition of the incoming combustion charge. The buildup of such deposits can also reduce the effective volume of the combustion chamber, which results in a higher compression ratio and further potential problems with detonation. Spark plug fouling can also occur, which results in poor or intermittent ignition and accompanying inefficiencies.

Additional environmental problems can occur as a result of excessive oil consumption, as well. Any oil which exits the combustion chamber through the exhaust will pass through the catalytic converter(s). While catalytic converters are intended to combust unburned hydrocarbons, contamination with excessive oil may result in more unburned hydrocarbons than the catalytic converter(s) is/are capable of handling, resulting in excessive heat to the converters and subsequent damage, and/or contaminating the converter elements with oil and reducing their efficiency. Oil contamination of the oxygen sensor in exhaust systems is yet another problem, which can lead to the engine control unit delivering improper fuel/air ratios and ignition timing to the engine, with resulting inefficiencies and reductions in fuel economy. Finally, excessive oil passing out the exhaust and into the environment is obviously not desired.

The present inventor has tested the invention by installing it in a General Motors LS-1 engine which is installed in his personal automobile. Testing has shown a significant reduction in oil consumption, with the accompanying benefits to the engine and to the environment noted above.

The present reinforcement plate is formed of a flat sheet of metal. Preferably, a high strength steel plate (e.g., cold rolled steel plate) is used for maximum strength. Other metals may be used as desired, even as soft as aluminum, depending upon the specific engine and reinforcement plate thickness, or more costly materials, such as corrosion-resistant steel and titanium.

The present reinforcement plate has a generally rectangular configuration, with a width slightly narrower than the lower skirt of the engine block in order to provide clearance therebetween. A series of crankshaft counterweight and throw clearance openings are provided through the present reinforcement plate, with a series of lateral ribs or bars extending across the plate between the opposite sides thereof and the openings therein. The lateral ribs correspond in number to the number of main bearing caps in the engine, and bolt to the main bearing caps using the conventional bearing cap bolts. The result is a component which greatly increases the strength of the lower portion of the engine, without requiring any modification of the engine or additional components and which also provides the same clearance beneath the engine as achieved by the stock engine.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a reinforcement plate for the bottom end (i.e., crankshaft location) of a reciprocating engine. The present reinforcement place bolts to the main bearing caps of the engine, further immobilizing the caps relative to one another and restricting the slight relative motion which would otherwise occur due to engine operation. The result is an engine block which is more resistant to fatigue stresses, as well as better alignment of the main bearings.

Figure 1:
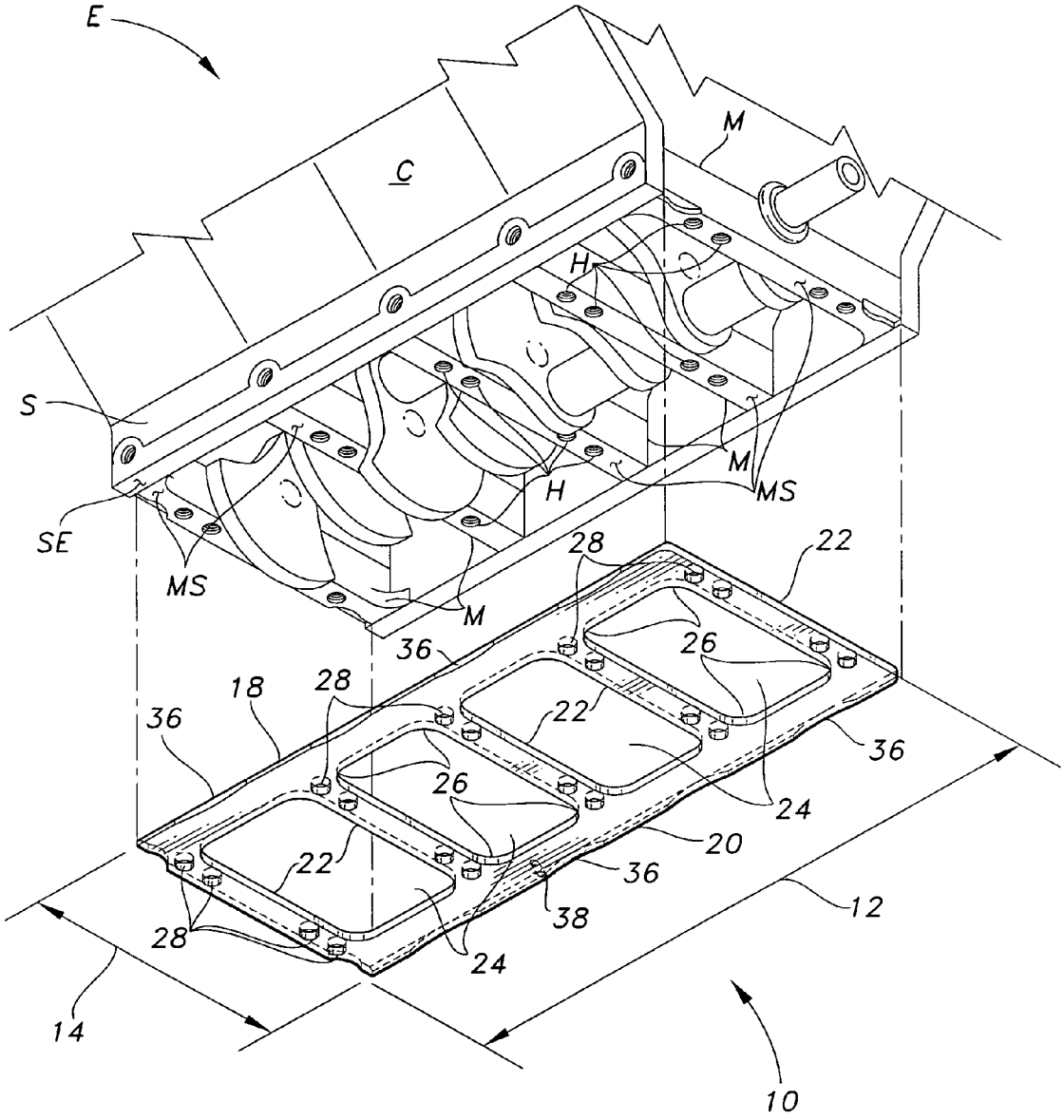
FIG. 1 is an exploded bottom, right front perspective view of the lower portion of a reciprocating engine, showing the installation of the present reinforcement plate thereon.

FIG. 1 provides a bottom and right side exploded perspective view of the present plate 10, separated from the bottom end of a conventional reciprocating engine E. The engine E may be of any conventional configuration, but the present plate 10 is well adapted for installation in a General Motors LS-1 type engine. These engines have a V-8 configuration and a nominal displacement of 5.7 liters, or 350 cubic inches. The LS-1 engine is used in innumerable high performance applications, and as such is provided with six bolt main bearing caps M as it is manufactured. A total of five such main bearing caps M are provided in such engines E, with each cap M having two bottom or lower main bearing cap bolts B or studs (shown in FIG. 2) passing through the lower surface MS of the main caps M to either side of the crankshaft centerline and another lateral bearing cap bolt L (FIG. 2) through the lower portion of the crankcase skirt S.

The crankcase or lower block skirt S is relatively deep on such engines, with the lower edge SE of the skirt S being coplanar with the lower surface MS of the main bearing caps M. The main bearing caps M span the entire width of the interior of the crankcase C, between the two sides of the depending skirt S. This provides a reasonably rigid structure for the moving components of the engine E. However, as the cases C of such engines E are commonly cast of aluminum alloy, some flexure normally occurs during operation, particularly when the engine E has been modified to produce significantly more power than stock. This flexure can lead to fatigue failures of the crankcase C, as well as misalignment of the main bearings and their caps M.

The present invention greatly reduces such flexure, as noted further above. Power impulses produced during engine operation result in some flexure of the engine block or crankcase C, on the order of minute fractions of an inch at a rate of hundreds of Hz, depending upon engine rpm and power output. This also results in some relative movement of the main bearing caps M, as they are mechanically affixed (i.e., bolted) to the engine crankcase C. The reduction of relative movement of the bearing caps, and reduction of block or crankcase flexure, greatly improves the alignment of the main bearings, thereby reducing main bearing friction and wear on the crankshaft journals and bearing shells.

Figure 3:
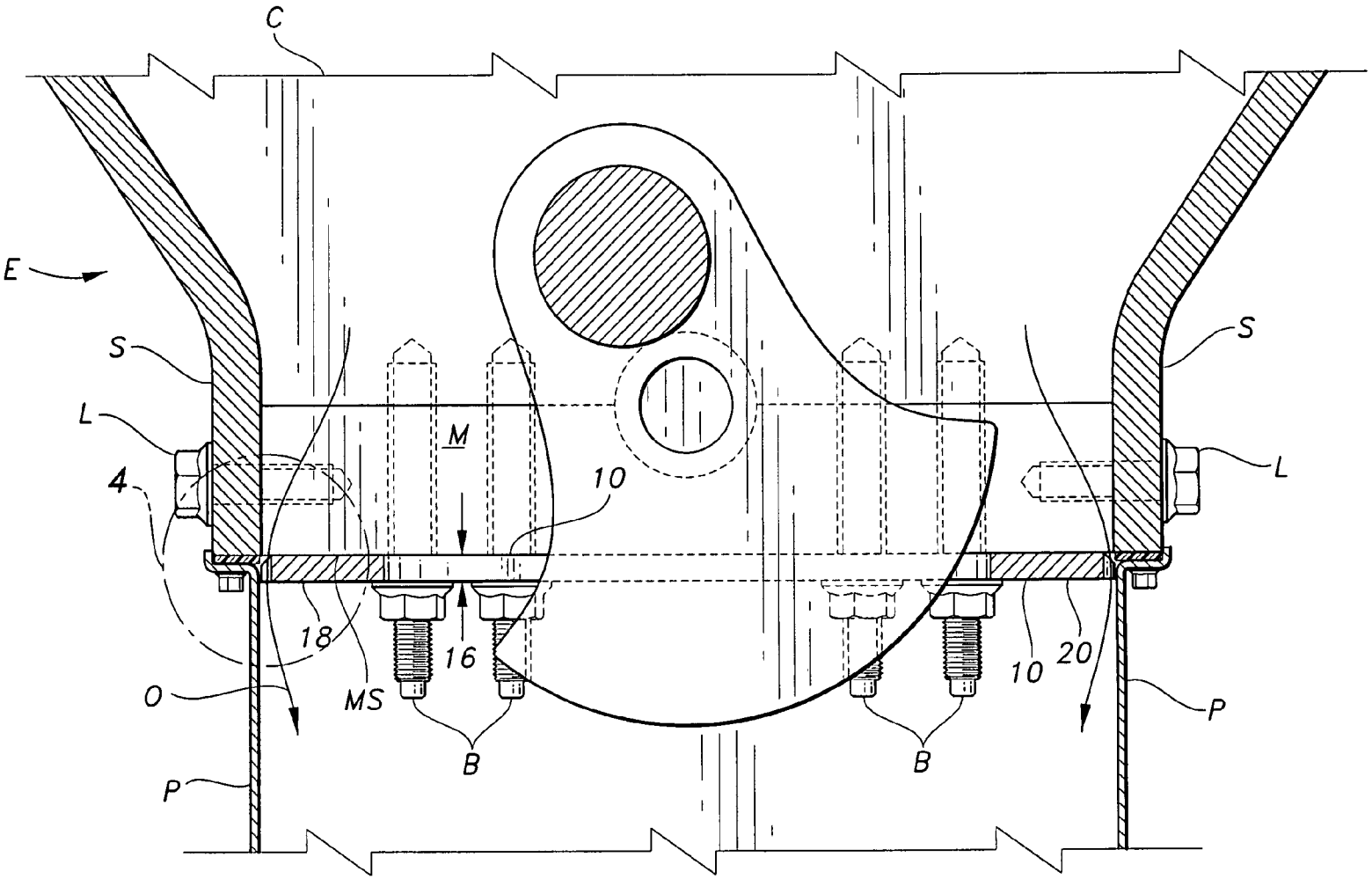
FIG. 3 is a front elevation view in section across the engine and plate assembly of FIG. 2, showing the installation of the oil pan therewith.
Figure 4:
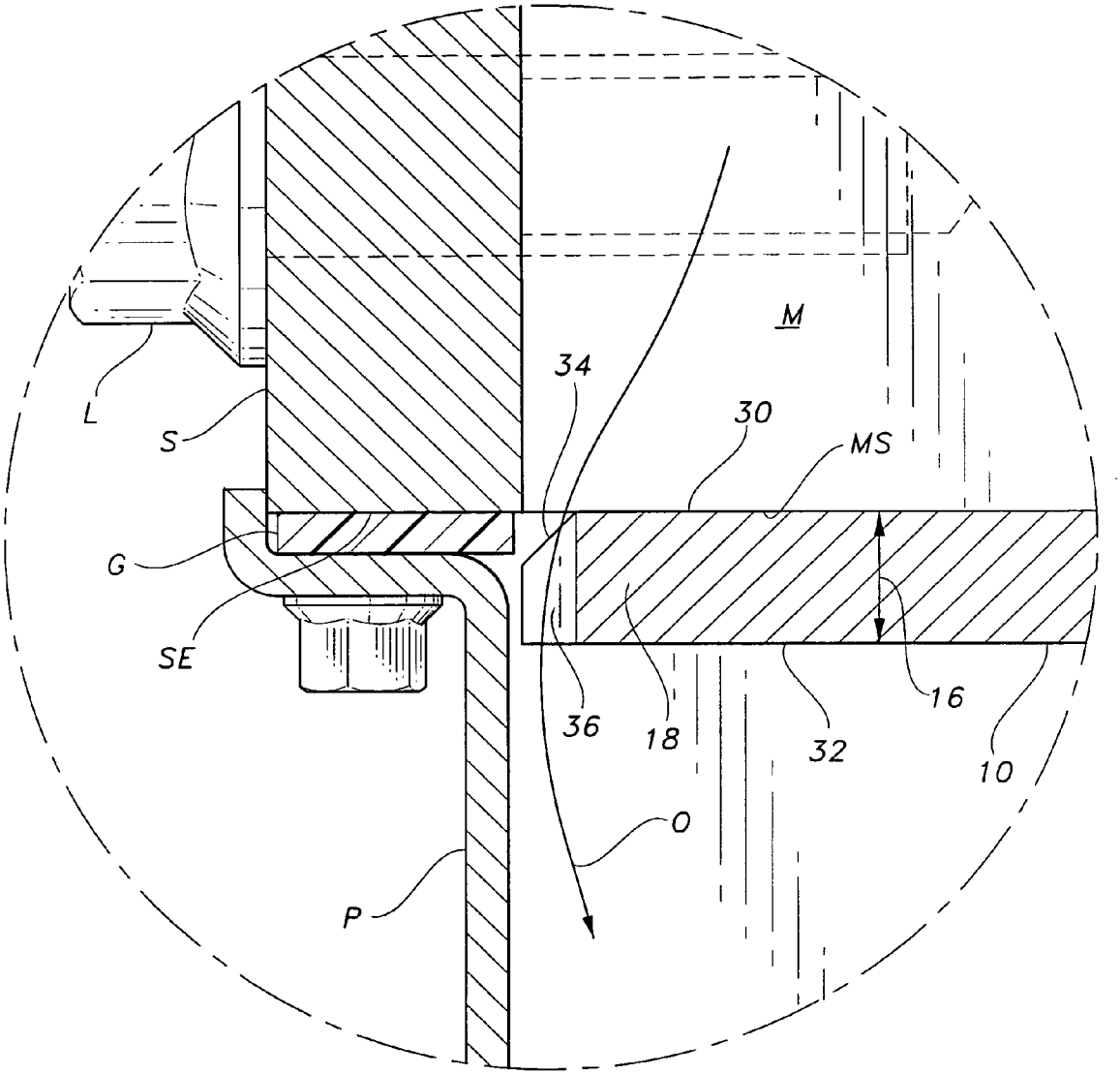
FIG. 4 is a detailed front elevation view in section of portion 4 of FIG. 3, showing the detail of the oil pan gasket clearance and oil flowthrough provided by the present engine reinforcement plate.

The plate 10 comprises a unitary, monolithic flat plate formed of a single sheet of material, with a length 12 which extends across all of the five main bearing caps M of the engine E. The plate 10 is relatively wide as well, having a width 14 which extends completely across the crankcase between the two sides of the lower skirt S, but does not overlap or contact the skirt S or its lower edge SE. The plate 10 is preferably formed of high strength steel, e.g. 4340 alloy, to provide the desired resistance to flexure for the crankcase C and bearing caps M to which it is bolted. By using such a high strength steel having such a relatively wide span, the reinforcement plate 10 may be formed as a relatively thin plate, with a thickness 16 (shown in FIGS. 3 and 4) of about one quarter inch. As the plate 10 does not intrude between the lower skirt edge SE of the crankcase skirt S and the oil pan P, as shown in FIGS. 3 and 4, the overall depth of the complete engine assembly E is unchanged from stock.

The reinforcement plate 10 includes mutually opposed first and second side members, respectively 18 and 20, which are positioned immediately adjacent and inboard of the respective lower skirt edges SE of the engine block or case C when the plate 10 is installed within the engine E. A series of spaced apart lateral ribs or crossmembers 22 spans the area between the two side members 18 and 20, with the ribs 22 aligned across the main bearing caps M of the engine E to provide for attachment thereto.

The ribs 22 define a series of crankshaft counterweight and throw passages 24 therebetween, to allow the offset crankshaft throws and their opposed counterweights to rotate through the passages 24 without interference with the reinforcement plate 10. The crankshaft counterweight and throw passages 24 preferably have a generally rectangular configuration as shown in order to provide the desired clearance, but also preferably include a smoothly rounded stress relief radius 26 at each of the internal corners.

Figure 2:
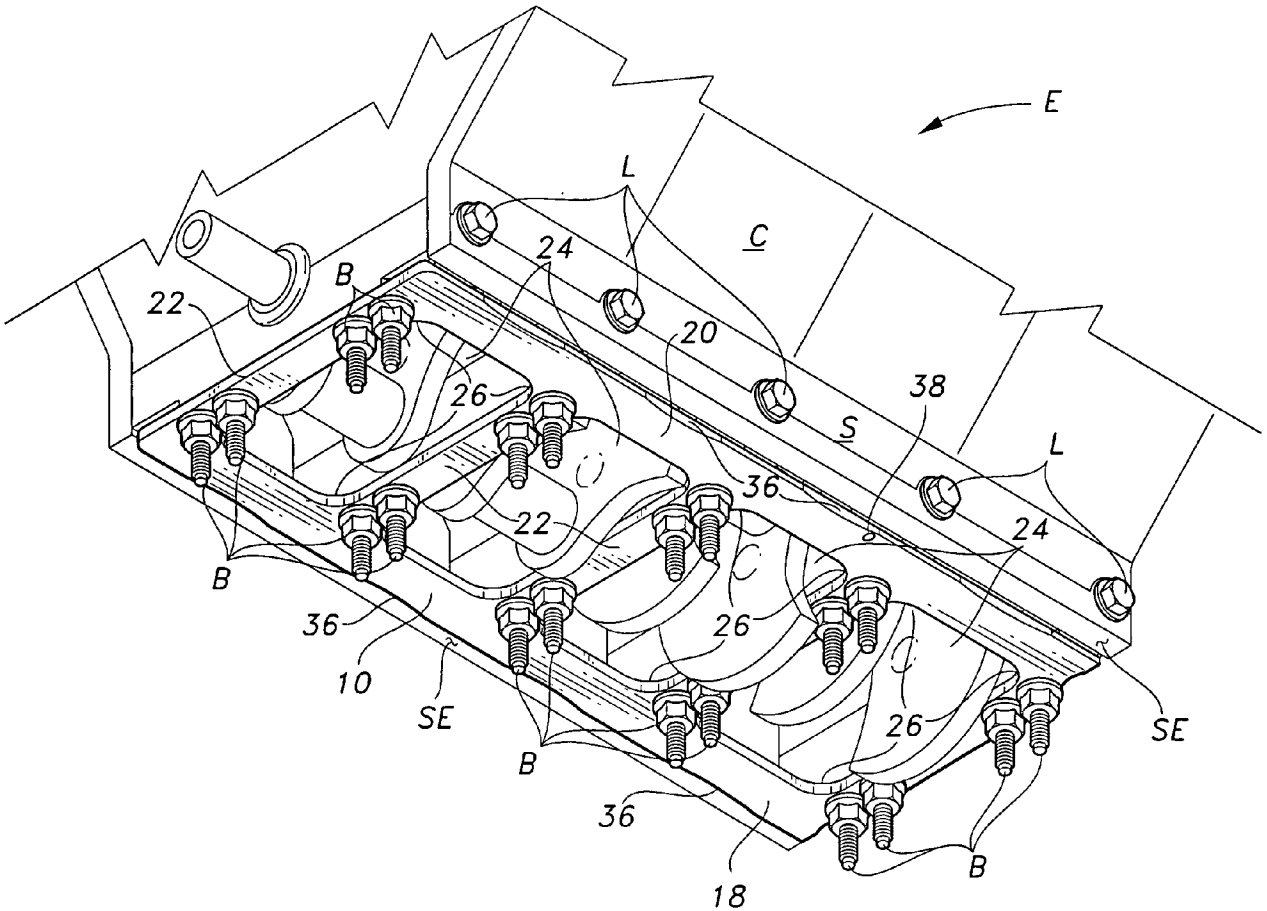
FIG. 2 is a bottom, left front perspective view of the lower portion of the reciprocating engine of FIG. 1, showing the completed installation of the present reinforcement plate

The ribs or crossmembers 22 provide for the attachment of the plate 10 to the main bearing caps M to tie the caps M more securely together by means of the monolithic configuration of the plate 10, as described further above. Each of the ribs 22 includes a series of main bearing cap bolt holes or passages 28 therethrough, shown in FIG. 1, corresponding in number and position to the bolt or stud holes H formed in the main bearing caps M. This allows the plate 10 to be secured across all of the main bearing caps M by means of the main bearing cap studs and nuts or bolts B, as shown in FIGS. 2 and 3.

The reinforcement plate 10 spans the entire width of the lower crankcase C between the two skirt edges SE, although it is not coplanar with the skirt edges SE. Nevertheless, little space exists between the extreme edges of the two sides 18 and 20 of the plate 10 and the crankcase skirt edges SE immediately adjacent and outboard thereof. The very small clearance between the extreme outer edges of the two sides 18 and 20 of the plate and the adjacent lower inboard skirt edges SE of the engine block or case C, can restrict oil flow downward from the cylinders and crankshaft bearings and back to the oil pan P. This is particularly true if the oil pan gasket G (shown clearly in FIG. 4) extends inwardly to contact the outer edges of the first and second sides 18 and 20 of the plate 10. While the oil can still run downwardly through the large openings of the crank throw passages 24, it may tend to pool along the juncture of the edges of the two sides 18 and 20 of the plate 10 and the inboard lower edges SE of the crankcase skirt S.

Accordingly, the plate 10 may include some form of relief area(s) to provide clearance for the gasket G and to facilitate oil drainback to the pan P. FIG. 4 provides a detailed view of the clearances provided along the first side 18 of the plate 10, with the opposite second side 20 having identical clearances. The plate 10 includes a first or main bearing cap contact surface 30, and an opposite second surface 32. The extreme edges of the two plate sides 18 and 20 each include a bevel 34 along the first, main bearing contact surface 30 to provide clearance for the oil pan gasket G, generally as shown in FIG. 4.

Further clearance is provided for oil drainback by a series of widely radiused oil drainback clearance reliefs 36, formed along each outer edge of the plate 10. These relief radii 36 are shown most clearly in the cross sectional view of FIG. 4, but are also visible in FIGS. 1 and 2 of the drawings. The oil passage relief radii 36 are preferably formed as large radius curves opposite each of the crank throw and counterweight clearance passages 24, in order to avoid the creation of stress risers resulting from sharp corners and/or deep indentations along the edges of the plate 10. However, other means of providing for oil drainback along the edges of the plate 10 may be provided as desired, e.g. a larger number of smaller radius reliefs, a series of smaller holes along the outer edges of the plate 10, or merely by forming the plate 10 with a slightly narrower width in order to provide a greater clearance between the outer edges of the plate 10 and the lower edges SE of the crankcase skirt S and the oil pan gasket G. These oil drainback reliefs 36 provide clear passage for oil to run back into the oil pan, as indicated by the oil return flow arrow 0 in FIGS. 3 and 4.

Most reciprocating engines are equipped with a so-called "wet sump" oil system, wherein the oil drains back to a lower oil pan P or sump after being pumped through the engine. Such systems are conventionally equipped with some means to check the quantity of oil before operation, e.g. a dipstick which extends downwardly into the oil sump or pan P. The present reinforcement plate 10 greatly restricts communication between the engine block or crankcase C and the oil pan P along the inner sides of the case C and pan P; hence the need for the gasket clearance bevel 34 and oil passage radii 36, described immediately above. This restriction also limits the insertion of a dipstick or similar device downwardly from the side of the case C into the oil pan P, unless some provision is made for such. Accordingly, an oil dipstick passage 38 may be provided at the appropriate location through one of the sides 18 or 20 of the plate 10, depending upon the location of the oil dipstick tube in the engine block or case C with which the present plate 10 is installed. The dipstick passage 38 may be formed with its axis normal to the plane of the plate 10, or may be angled to match the axis of the dipstick and its tube as installed on the engine.

Figure 5:
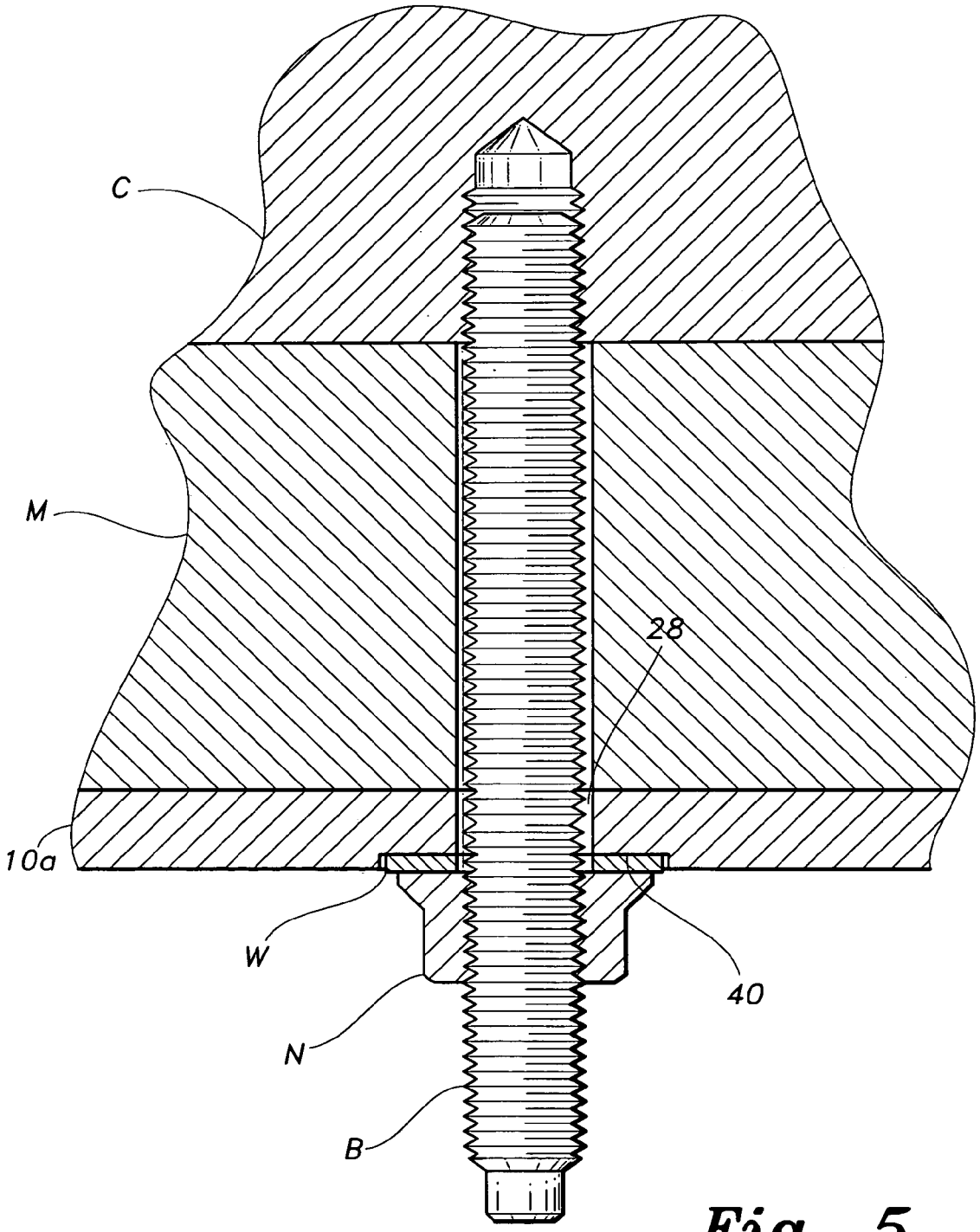
FIG. 5 is a detailed elevation view in section of a single bearing cap and reinforcement plate attachment bolt, showing an exemplary spot face formed in the lower surface of the lower surface of the plate.
Figure 6:
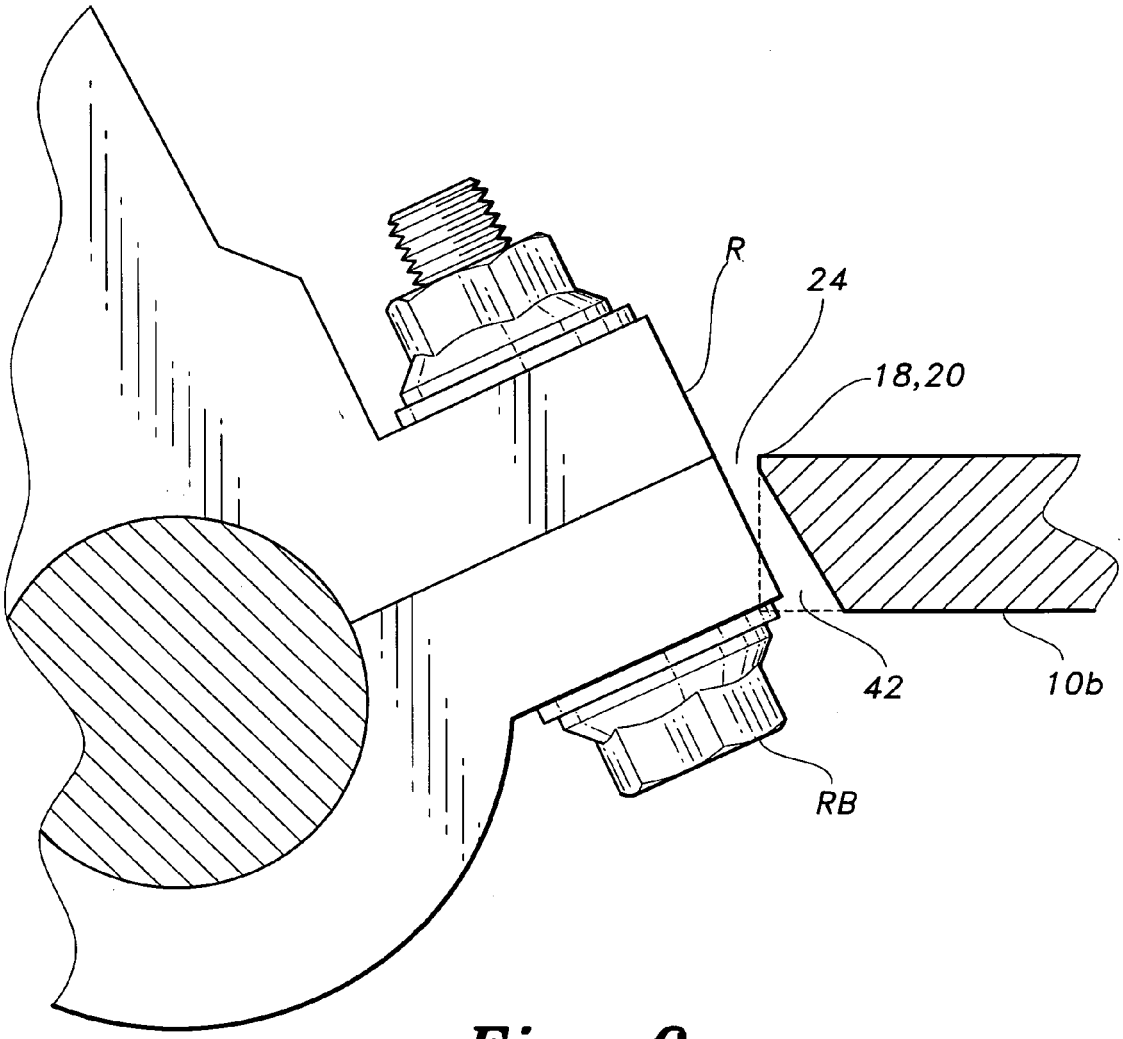
FIG. 6 is a detailed elevation view in section through one of the crankshaft and connecting rod clearance passages of the reinforcement plate, showing an alternative relief for clearance of larger connecting rod assemblies.

FIGS. 5 and 6 illustrate alternative modifications which may be made to the present reinforcement plate. In FIG. 5, the single bolt hole or passage 28 of the modified plate 10*a* has been provided with a spot face or shallow counterbore 40 to assist in the accurate seating and alignment of the washer W between the nut N and the reinforcement plate. Alternatively, the washer W could be eliminated in certain installations, if so desired, particularly where nuts N are provided with a relatively large diameter circular bearing face, as shown in the drawings. FIG. 6 illustrates another alternative modification to the present reinforcement plate, wherein a plate 10*b* is modified for greater clearance for a relatively large connecting rod lower end assembly R. At times it may be necessary to provide greater clearance for such rod end assemblies R, if the engine is "stroked" by grinding the crankshaft, if a larger throw crankshaft is installed, and/or connecting rod assemblies of heavier and more durable construction are installed. The engine reinforcement plate 10*b* of FIG. 6 accommodates such a larger rod end assembly R and its rod bolt RB by means of a clearance relief 42 cut away from the inner edge of the side portion 18 and/or 20, adjacent the crankshaft and counterweight throw passages 24. A minimal amount of material may be removed in the plane of the lower end of the rod assembly R in order to maintain the desired rigidity of the reinforcement plate 10*b*. It will be understood that the modifications of the plates 10*a* and 10*b* shown in FIGS. 5 and 6 may be applied to one another, and/or to the plate 10 shown in FIGS. 1 through 4 as desired.

In conclusion, the present reinforcement plate for reciprocating engines provides a much needed solution to the problem of engine flexure during operation, particularly at very high power outputs. While the stock engine provides very good durability, modified engines producing considerably more power than stock are also prone to considerably greater internal forces than stock. These forces produce torsional and other reactions in the engine block and main bearing caps, which absorb perhaps the greatest amount of internal forces produced by the engine and transfer those forces to the engine block or crankcase. The present reinforcement plate serves to tie all of the main bearing caps rigidly together, in addition to their bolted attachment to the bearing webs and (in the LS-1 engines) to the sides of the crankcase skirt. The result is a much more rigid engine which is much more resistant to fatigue and resultant damage, even at very high power outputs, and which maintains the alignment of the main bearings to a much greater degree than stock engines, thereby reducing friction and prolonging bearing life. The present reinforcement plate will be much appreciated by those in the aftermarket who have occasion to modify such engines for greater power output, as the present plate allows them to do so without unduly sacrificing engine reliability.

It is to be understood that the present invention is not limited to the embodiments described above, but encompasses any and all embodiments within the scope of the following claims.

I claim:

1. A reinforcement component for a reciprocating engine, the engine having a crankcase with a lower skirt and containing a plurality of main bearing caps secured by a plurality of main bearing cap bolts, the reinforcement component comprising:

a unitary, monolithic, flat plate having a length spanning all of the main bearing caps and a width extending across the lower skirt of the crankcase of the engine, the plate having;

mutually opposed first and second side portions adapted for being disposed immediately within and adjacent the lower skirt of the crankcase of the engine when the plate is installed therein; and a plurality of lateral ribs extending between the first and second side portions corresponding in number to the plurality of main bearing caps and defining a plurality of crankshaft counterweight and throw passages therebetween, each of the lateral ribs having a plurality of bearing cap bolt passages defined therethrough corresponding in number to the plurality of main bearing cap bolts.

2. The reinforcement component according to claim 1, wherein said plate has a thickness of substantially one quarter of an inch.

3. The reinforcement component according to claim 1, wherein said plate is formed of high strength steel.

4. The reinforcement component according to claim 1, wherein:

each of said crankshaft counterweight and throw passages has a generally rectangular configuration; and each of said crankshaft counterweight and throw passages further includes, an internal stress riser relief radius at each internal corner thereof.

5. The reinforcement component according to claim 1, wherein said plate further includes a first main bearing cap contact surface and a second surface opposite the first surface, each of said side portions having a beveled gasket clearance edge along the first surface thereof.

6. The reinforcement component according to claim 1, wherein each of said side portions further includes a plurality of wide oil drainback radii therealong.

7. The reinforcement component according to claim 1, wherein one of said side portions has an oil dipstick clearance passage therethrough.

8. The reinforcement component according to claim 1, wherein said crankshaft and counterweight throw passages each have a connecting rod end assembly clearance relief disposed along at least one of said side portions.

9. A reciprocating engine and a reinforcement component attached thereto, comprising in combination:

an engine crankcase, having;

a lower skirt having a lower edge depending from said crankcase;

a plurality of main bearing caps, each of the caps having a lower surface, the caps being installed within said crankcase;

a plurality of main bearing cap bolts securing said main bearing caps within said crankcase;

a unitary, monolithic, flat plate installed to said engine crankcase and having a length spanning all of said main bearing caps and a width extending across said lower skirt, the plate having;

mutually opposed first and second side portions disposed immediately within- and adjacent said lower skirt; and a plurality of lateral ribs extending between the first and second side portions of said plate, corresponding in number to said plurality of main bearing caps and defining a plurality of crankshaft counterweight and throw passages therebetween, each of said lateral ribs having a plurality of bearing cap bolt passages defined therethrough corresponding in number to said plurality of main bearing cap bolts.

10. The reciprocating engine and reinforcement component combination according to claim 9, wherein said plate has a thickness of substantially one quarter of an inch.

11. The reciprocating engine and reinforcement component combination according to claim 9, wherein said plate is formed of high strength steel.

12. The reciprocating engine and reinforcement component combination according to claim 9, wherein:

each of said crankshaft counterweight and throw passages of said plate has a generally rectangular configuration; and each of said crankshaft counterweight and throw passages of said plate has an internal stress riser relief radius at each internal corner thereof.

13. The reciprocating engine and reinforcement component combination according to claim 9, wherein:

said plate further includes a first main bearing cap contact surface and a second surface opposite the first surface; and each of the side portions of said plate has a beveled gasket clearance edge along the first surface thereof.

14. The reciprocating engine and reinforcement component combination according to claim 9, wherein each of the side portions of said plate further includes a plurality of wide oil drainback radii therealong.

15. The reciprocating engine and reinforcement component combination according to claim 9, wherein one of said side portions of said plate has an oil dipstick clearance passage therethrough.

16. The reciprocating engine and reinforcement component combination according to claim 9, wherein said crankshaft and counterweight throw passages each have a connecting rod end assembly clearance relief disposed along at least one of said side portions.

17. The reciprocating engine and reinforcement component combination according to claim 9, wherein each of the lower surfaces of said plurality of main bearing caps of said engine crankcase is coplanar with the lower edge of the lower skirt of said engine crankcase.

18. The reciprocating engine and reinforcement component combination according to claim 9, wherein said engine crankcase has a V-8 configuration.

19. The reciprocating engine and reinforcement component combination according to claim 9, wherein each of said main bearing caps comprises four main bearing cap bolts extending through the lower surfaces thereof.

20. The reciprocating engine and reinforcement component combination according to claim 9, wherein said engine crankcase us formed of aluminum.

* * * * *